United States Patent [19]

Willits et al.

[11] Patent Number: 4,809,188

[45] Date of Patent: Feb. 28, 1989

[54] STRIP FEEDING AND CONTROL SYSTEM

[75] Inventors: Samuel P. Willits, Barrington; Thomas E. Kleeman, W. Dundee; William L. Mohan, Barrington Hills, all of Ill.

[73] Assignee: Spartanics, Ltd., Rolling Meadows, Ill.

[21] Appl. No.: 920,587

[22] Filed: Oct. 17, 1986

[51] Int. Cl.[4] ..... G06F 15/46; B65H 23/18

[52] U.S. Cl. ..... 364/469; 226/28; 250/548; 250/571; 318/640

[58] Field of Search ..... 364/468, 469, 559; 250/227, 548, 557, 561–563, 571, 572; 226/2, 9, 13, 24, 27, 28, 29, 32, 34, 35, 38, 44, 45; 318/640, 39; 356/394, 396, 401, 237, 429–431; 83/71, 72, 405, 414; 101/248, 22 C, DIG. 21

[56] References Cited

U.S. PATENT DOCUMENTS

| | | | |
|---|---|---|---|
| 3,670,153 | 6/1972 | Rempert et al. | 250/548 X |
| 3,774,016 | 11/1973 | Sterns et al. | 364/469 X |
| 4,243,925 | 1/1981 | Gnuechtel | 318/640 X |
| 4,264,957 | 4/1981 | Pautzke | 364/469 |
| 4,318,176 | 3/1982 | Stratton et al. | 364/469 |
| 4,361,260 | 11/1982 | Hanlan | 364/469 X |
| 4,484,522 | 11/1984 | Simeth | 364/469 X |
| 4,528,630 | 7/1985 | Sargent | 364/469 |
| 4,532,596 | 7/1985 | Pugsley | 364/469 |

*Primary Examiner*—Joseph Ruggiero
*Attorney, Agent, or Firm*—Jacque L. Meister

[57] ABSTRACT

A material positioning and registering system for patterned material incorporating a computer with associated memory and software. A material moving system employing a drive roller with associated pressure roller in a novel pinch roller system, moves the material. A motion detecting sensing device driven by the pressure roller and an optical sensor for viewing the patterned material, each provide outputs to a computer which, in turn, provides control of material movement and optical sensor operation and may, provide signals for initiating machining of the patterned material when the pattern is properly located relative to a designated work station.

27 Claims, 3 Drawing Sheets

STRIP FEEDING AND CONTROL SYSTEM

BACKGROUND OF THE INVENTION

This invention relates generally to registration of indicia bearing material relative to a tool to be employed in an operation or series of operations on the material and more particularly to optical sensor means for sensing the indicia, a material positioning system and a control system responsive to the output of the sensor to direct the positioning system to establish the indicia bearing material relative to the sensor.

In many machining operations it is necessary to accurately position decorated or indicia bearing material in a machining area for subsequent punching, drilling, machining, hot stamping, or component mounting. The purpose of the positioning is to provide accurate register between the decorated pattern or indicia pattern on materials such as credits cards, nameplates, printed circuit boards or previously partially fabricated materials and a tool or tools for a machining operation.

In addition, each of these operations may be repeated on one piece of material. This can require complex motion control in both the gross, or approximate, positioning and in the final accurate, or pattern register, positioning.

There are other material positioning applications which only require accurate control of the edge of the material in a machining area plus accurate control of material advance. Where this is the case, pattern registration is not required.

Register errors between indicias or patterns on material and pre-pierced register holes or edges can be generated many ways. Four of the most common sources of register errors are:

(1) Dimensional changes in the material during processing after the indicia or pattern is affixed on the material.

(2) Incorrect original positioning of the indicia or pattern on the material.

(3) Accumulated errors when recording multiple patterns on a single piece of material due to errors in generating original artwork.

(4) Changes in material dimensions due to machining.

When accurately positioning decorated material for machining it is often necessary to correct for these or other register errors that have previously occurred in the process. This requires sensing the position of a known feature of the pattern and positioning the patterned material relative to the machining position in response to the sensed pattern feature position.

The sensing of the pattern and control of the material location can be accomplished visually with optical aids and manual controls, or an optical or other pattern sensor can be used to control servo systems to automatically register the pattern Another source of system errors that can be imposed by the needs of the machining process is the frequently encountered requirement for sensing the pattern with the material in one position, and then moving the material to another position for machining. Another system requirement can be the need for high speed loading and unloading of the material.

The inventive equipment which simultaneously solves the foregoing and other register problems and operates within the limits of these requirements or needs, comprises an inventive optical pattern brightness detector, an inventive material moving mechanism, and an inventive computer based control system.

The inventive optical pattern brightness detector comprises a unique arrangement of illumination source, optical elements and sensing elements which provides in one device precise brightness sensing on both reflective and diffuse surfaces with no parallax errors, a well defined sensing area, and a large separation between the detector sensor body and the decorated material being sensed. These attributes are important when the material surface characteristics, its thickness, and its smoothness vary widely The detector sends pulsed data indicative of the pattern edges in the sensing area on the patterned material to the inventive computer control system as the material moves past the sensing area.

The inventive material moving mechanism comprises a servo drive motor, an encoder, and material control rollers uniquely arranged to accurately sense and control the movement of decorated material during positioning while also allowing for high speed material loading and unloading. In some applications a pair of inventive material moving mechanisms are used. This allows complete control of short strips or sheets of decorated material in a machining area with no part of the paired mechanisms being located in the machining area.

The inventive computer based control system combines the material movement data from the encoder or encoders with pattern edge position pulses from the pattern brightness detector or detectors. The control system generates single axis servo motor control signals for high speed precision register positioning of the decorated material in the machining area. This precision register positioning in the machining area can be accomplished with no part of the inventive equipment located in the machining area. The system also generates signals required to initiate the machining operations sequence after the material is positioned, or before the material is positioned but timed so the actual machining operation occurs after the material is positioned When the inventive combination of pattern edge detector, material moving mechanism and control system are used to detect a particular type of target on the decorated material the system can generate 2-axis high speed servo motor control signals Various sensing devices and material positioning systems have been devised to perform tasks analogous to those of the inventive system. In particular, the Jallais U.S. Pat. No. 3,714,447 describes an apparatus for the photo-optical reading of the marks and perforations on record media; the Kissinger U.S. Pat. No. 3,940,608 describes a fiber optic displacement measuring apparatus and the Kessler, et al, U.S. Pat. No. 3,584,779 describes an optical data reading system. Additionally, the Papsdorf U.S. Pat. No. 3,957,188 describes a punched tape control system and the Schulze, et al, U.S. Pat. No. 4,398,657 describes a feeding device for the cyclic feeding of rod or tape like material in presses, cutters and the like.

While each of the foregoing enumerated devices and others have attacked various parts of the indicia pattern location, movement of the indicia or pattern and control of the two in conjunction with one or more machining operations, none have attempted to provide them in a single device and system, nor have they achieved the positioning accuracy necessary to meet contemporary standards.

SUMMARY OF THE INVENTION

It is a principal object of the invention to provide a new and improved system for determining the position and quality of a pattern indicia, location of that pattern indicia into a machining area and machining initiation.

Another object of the invention is to provide a new and improved pattern indicia location system.

Yet another object of the invention is to provide a new and improved pattern indicia location and evaluation system responsive to patterns having either reflective or diffuse surfaces Another object of the invention is to provide a new and improved pattern indicia location and evaluation system with substantially increased spacing between the pattern indicia and the location system than achievable with prior art systems A further object of the system is to provide in a material moving mechanism, a unique arrangement of components to permit more accurate material positioning than heretofore possible A still further object of the invention is to provide a computer based control system that combines input data from the pattern indicia location system and the material moving system to enable more precise location of the pattern indicia in the machining area and means for initiating the machining and responsive to machining termination to initiate further pattern indicia - material movement - machining cycles, and means for terminating the machining when machine damage is imminent.

The foregoing and other objects of the invention are achieved by the inventive system which provides an optical pattern brightness sensing system, a material moving system employing a shaft position encoder in a novel pinch roller system and a computer based control system for the sensing system and material moving system. The nature of the invention and its several features and objects will more readily be apparent from the following description of certain preferred embodiments thereof taken in conjunction with the accompanying drawings.

DESCRIPTION OF THE PREFERRED EMBODIMENTS

Figure 1:
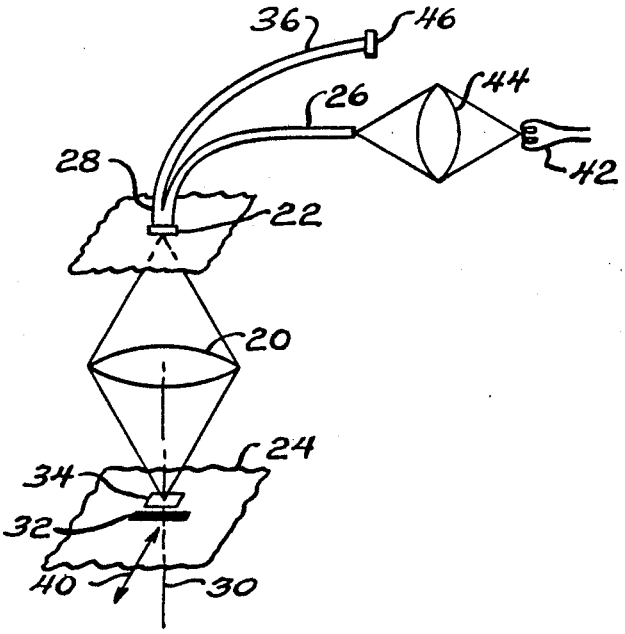
FIG. 1 is a schematic diagram in partial perspective illustrating the principal components of the inventive optical pattern brightness detector of the invention.

The inventive pattern edge detector combines optical fibers and conventional optics in a unique way to provide an optically fast, low cross-talk, coaxial, reflective and diffuse pattern sensing system with large depth of field, no parallax, well defined sensing area, and large separation between detector body and pattern. The detector details are shown in FIG. 1. Objective lens 20 has a plane of focus near Image area 22 and another plane of focus near object plane 24. Objective lens 20 focusses the illumination from the end of the illumination fibers 26 in image area 22 onto the pattern located in object plane 24. The center of the end of combined fiber bundle 28 is located on optical axis 30. Objective lens 20 also focusses the image of pattern mark 32 back on the ends of combined fiber bundle 28. The resolution of objective lens 20 and the diameter of the fibers can be chosen so the ends of the individual illumination fibers 26 cannot be resolved on the pattern in object plane 24. The reason for this will become apparent as the details of the detector are further explained. The ends of the fibers in image area 22 are arranged alternately so sensor fibers are next to illumination fibers. With this arrangement, the unresolved illumination fiber images in object plane 24 spill over onto areas in sensing area 34 that objective lens 20 will image back onto sensor fiber ends in image area 22. With this arrangement the illumination of sensing area 34 is reasonably uniform at best focus even though the source of illumination in image area 22 is very nonuniform because sensor fibers 36 interspersed among illumination fibers 26 are dark.

Figure 2:
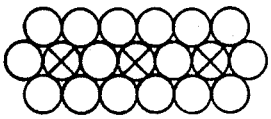
FIG. 2 shows in schematic form one advantageous arrangement of optical fibers of FIG. 1 at the image end of the fibers.
Figure 3:
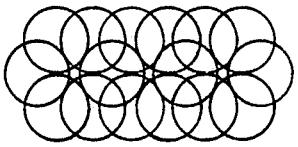
FIG. 3 schematically represents the illumination at the object plane of FIG. 1 with the optical fiber arrangement of FIG. 2.
Figure 4:
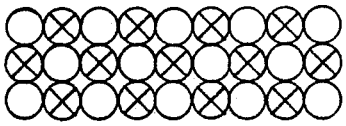
FIG. 4 illustrates in schematic form one advantageous arrangement of the optical fibers of FIG. 1 at the image end of the fibers.

To further clarify the inventive arrangement, FIG. 2 and FIG. 4 show typical arrangements of fiber ends in image area 22. Each circle represents the end of a fiber. The clear circles represent illumination fibers and circles with X's in them represent sensor fibers. If the blur circle of objective lens 20 was equal to the diameter of the fibers then the illumination in object plane 24 from the fiber arrangement in FIG. 2 would look like FIG. 3 with overlapping circles of illumination.

Figure 5:
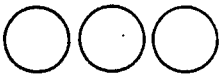
FIG. 5 is a graphic representation of the areas in the sensing plane of FIG. 1 that are imaged on the sensor fibers of FIG. 2.

The areas in the sensing area 34 which are imaged on the sensor fibers of FIG. 2 are shown in FIG. 5. This provides an effective sensing area for detecting the position of edges in a pattern.

The arrangement shown in FIG. 4 using the same fiber diameter has a larger effective sensing area and also provides more total reflected illumination back to the sensor through objective lens 20 and sensor fiber bundle 36. Because the effective sensing area is larger, the FIG. 3 arrangement does not have the ability to resolve fine pattern details as well as does the arrangement of FIG. 2.

If the size of a fiber imaged without optical degradation was small compared with the desired sensing area, and many fibers could be used in both sensor bundle 36 and illumination bundle 26, then a homogeneous mixing of fibers in image area 22 would provide excellent results in the inventive pattern detector.

If the pattern bearing material 38 is not in object plane 24, the resolution of the illumination fiber images on sensing area 34 is further degraded and the illumination of sensing area 34 becomes more uniform due to the greater spread of the image of each individual illumination fiber. Similarly, the areas in sensing area 34 which are imaged on the sensor fibers in image area 22 are also enlarged. The total effect of the material moving out of focus is to make the sensitivity of the sensing more uniform and to slightly enlarge the effective sensing area.

Referring again to FIG. 2 and FIG. 4; it can be seen that the typical fiber arrangements shown are symmetrical. For highest sensing accuracy with imperfect pattern marks (irregular or poorly printed) and relatively large imaged fiber diameter, it is important to provide such a symmetrical arrangement, With relatively small imaged fiber diameter, a homogeneous mixing of fibers without exact symmetry is satisfactory in most cases. As illustrated in FIG. 1, an effective sensing area 34 narrow in the direction being sensed 40 and long perpendicular to the sensing direction 40 provides both good mark sensitivity and good averaging of mark irregularities and provides accurate mark edge position detection for single axis registration.

Illumination source 42 is focussed on the illumination fiber bundle by condensor lens 44 and sensor 46 transduces the imaged information received from sensor fiber bundle 36.

The foregoing description of a pattern edge detector employing a bifurcated fiber optic bundle and optically fast lens system is preferred for its great versatility. However, systems employing a lens-less fiber optic-sensor system or systems having a lens-sensor arrangement without fiber optics can be utilized for a more limited range of material and mark characteristics.

Figure 6:
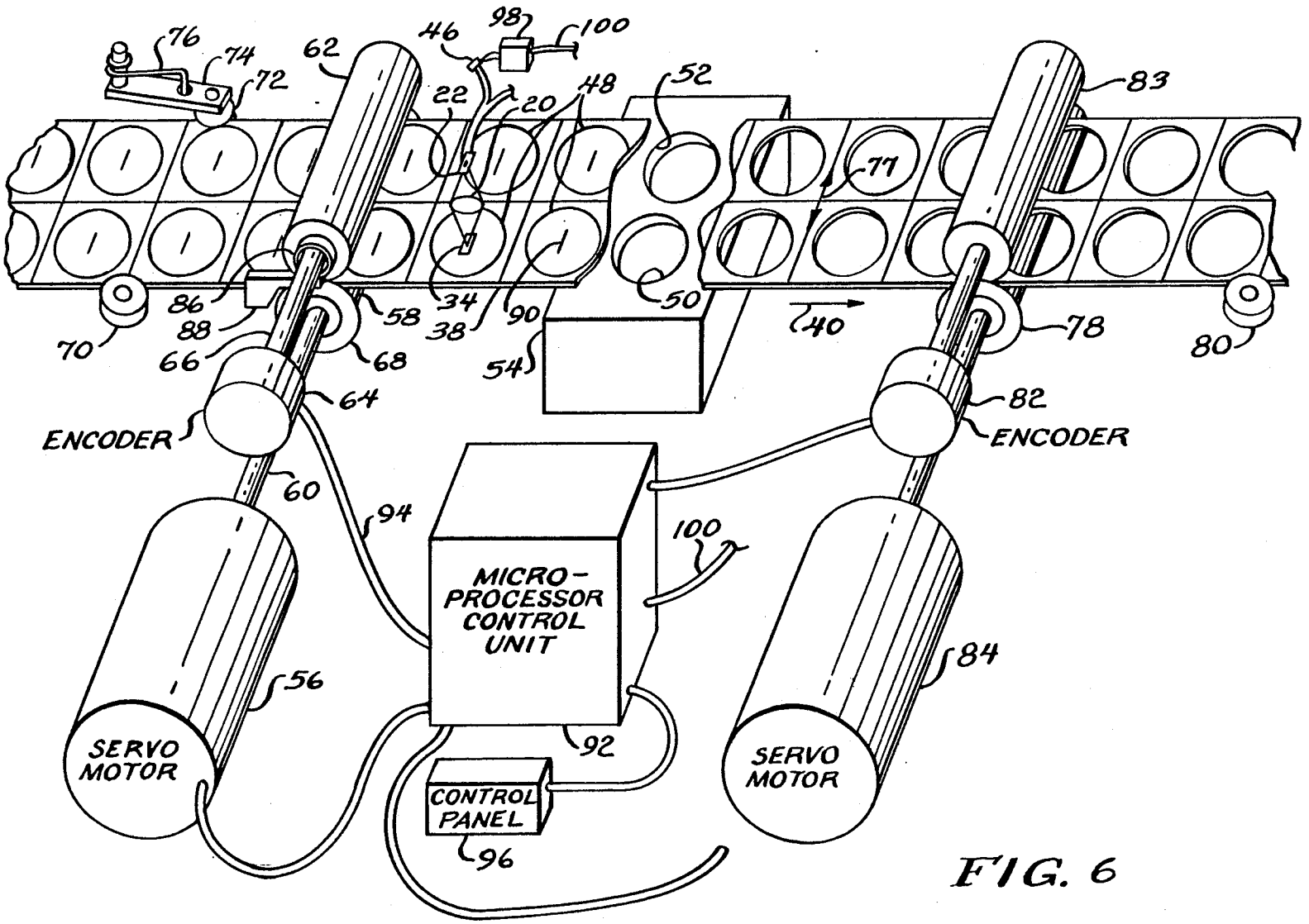
FIG. 6 is a schematic representation in perspective of the principal mechanical elements of the overall system comprising a pattern detector, material moving system and computer based control system.

FIG. 6 is a pictorial arrangement showing the principal mechanical elements in the inventive positioning system and pattern detector. The figure shows a strip or sheet of decorated material 36 with individual parts 48 to be registered and punched into and through holes 50 and 52 in die block 54. The punch press, die set, and punch required to actually punch the material are not shown.

Input servo motor 56 is coupled to input edge control drive roller 58 through shaft 60. Input encoder roller 62 drives rotary shaft encoder 64 through shaft 66. Encoder roller 62 is spring loaded to force material 38 against driver roller 58. Encoder roller 62 is not geared to drive roller 58 as in the typical roller feed Instead, material 38 is driven only by drive roller 58 and material 38, in turn, drives encoder roller 62, Encoder roller 62 is driven only by material 38 for two primary reasons. First, for improved accuracy in measuring material travel. Second, to provide a simple sensing system for detecting the beginning and end of material as it passes through the positioning system. These two reasons will be clarified later.

Figure 7:
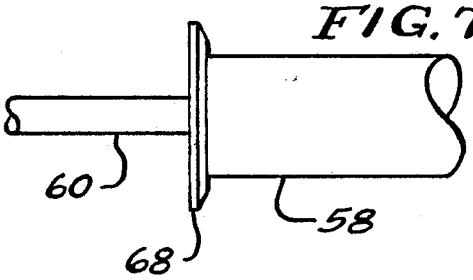
FIG. 7 is an enlarged view of a portion of FIG. 6 showing the drive roller of that figure.

Edge control driver roller 58 has a flange 68, and the axis of rotation of drive shaft 60 and encoder shaft 66 are not perpendicular to the direction of travel 40 of material 38. See FIG. 7 for an enlarged view of the flange on the drive roller. An angular offset of 0.1 degree to 5 degrees is introduced into the rotation axis to force material 38 against the drive roller flange 68 as the material is moved into the die area 54.

Side guide roller 70 and side pressure roller 72 control material side position ahead of control roller 58 and encoder roller 62. Arm 74 and torsion spring 76 provide the required movement control and pressure for side pressure roller 72. Position of material 38 in the in/out direction 77 normal to material motion direction 40, is controlled over die area 54 by the position of drive roller flange 68 and side guide roller 70.

The mechanical mounting of the component parts of the inventive material moving mechanism is not shown. The mounting must provide a stable support for all of the component parts relative to each other while allowing for adjustment of the entire group of components and thus material 38 toward or away from die block 54. This in/out adjustment of material 38 relative to die block 54 is required during setup to properly position the printed pattern in the in/out direction 77 over die holes 50 and 52.

Proper control of short strips of material requires a second inventive material moving mechanism located on the output side of the die area 54 with the output drive roller flange 78 controlling material edge position on the output side of the die. When the material 38 is gripped by both sets of material control wheels the two drive roller flanges 68 and 78 control the edge position of the material 38 in the die area 54. After the strip of material 38 leaves the input material control wheels, the edge position is controlled by output drive roller flange 78 and side guide roller 80, and control of pattern positioning in the die area 54 is transferred to output encoder 82 and output servo motor 84 by the inventive microprocessor control system.

The inventive control unit 92 automatically determines, based on the details of the strip set into the system, which sensed registration mark data will be used by the out encoder 82 for positioning strip 38 over die block 54. When data from a mark to be positioned by the out encoder 82 is about to be sensed, control of an activating window opening and closing is transferred to a base employing out encoder position data and the pulses generated by the edges of the mark sensed are then referenced to out encoder position data. In this way, all data to be used for positioning by the out encoder 82 is referenced to the out encoder. This is all controlled by the inventive control unit 92. In addition, control of the final positioning of material 38 is switched to the out encoder 82 at the proper time by control unit 92.

Machining of the material may change the physical dimensions of the remaining material web. If this happens, then the "advance to die" distance, the encoder measured travel of the mark 90 from sensor area 34 to dieblock 54, is different for the output encoder 82 than it is for input encoder 64. The correction for this different material travel is provided by the inventive control system and is manually set into the system as a "last parts correction." This correction is added into the measured mark position for all marks that are positioned by the output encoder 82.

When a second inventive material moving mechanism is used in this fashion, it is desirable that the mechanical mounting of the component parts of both mechanisms be moveable together in the in/out direction 77 to allow proper setup positioning of strip 38 in the in/out direction.

The foregoing description of the material moving and control system has primarily covered the precision control of sheet material in a single direction under optical control including detection of the position of the leading edge of the sheet material and patterns on the material. The material moving system can be used to provide accurate mechanical positioning of material without reference to a pattern by simply deactivating the pattern brightness sensor and setting the pattern characteristics to require no data.

As will be described below, it may be desirable to be able to servo control the in/out position 77 of strip 38. The design of the mechanical mounting assembly should also include the ability to be moved in the in/out direction 77 by a positioning device in order to accomplish the in/out positioning.

Brake drum 86 rotates with encoder roller 62. When there is no material between the rollers, encoder roller 62 does not contact drive roller 58. Brake drum 86 is supported by brake shoe arm 88. This holds encoder roller 62 away from drive roller 58. The separation must of course be less than the thickness of the material 38. Brake drum 86 pressing against brake shoe arm 88 prevents encoder roller 62 from turning unless material is between the rollers. If drive roller 58 is rotating in a clockwise direction without material, when material is pushed through side rollers 70 and 72 into the nip of dive and encoder rollers 58 and 62, brake drum 86 will be lifted off brake shoe arm 88 and encoder roller 62 will begin to rotate. Similarly, when the end of the material leaves the nip of drive and encoder rollers 58 and 62, brake drum 86 will be pressed down against brake shoe arm 88 and encoder roller 62 will stop rotating.

By a comparison of encoder 64 signals with the signals to servo motor 56, the computer based control system can generate material end signals for input to the overall registration program. One very simple criteria for the compare logic is: if drive motor 56 is rotating at some minimum speed and encoder 64 is not generating pulses at some minimum rate there is no material between rollers 62 and 58, or the material is jammed.

The inventive pattern detector, represented on FIG. 6 by objective lens 20 with sensing area 34 and imaging area 22, is preferably located between control rollers 58 and 62 and the machining area, represented by die block 54. By having the pattern detected as close as possible to the machining position, the material travel from pattern detection to register position in the machining area is minimized, thus minimizing the effects of errors in measuring material motion by encoder roller 62. If the machining area is such that the pattern detector can be located in the machining area then material travel measuring errors can be essentially eliminated by having material motion from pattern detecting position to register position very small. To improve accuracy even more, the pattern mark 90 being sensed by the pattern detector can be cyclically moved back and forth through sensing area 34, with sensed position stored each time (2 or more) through. In some cases, sensing errors can be reduced a factor of two or three by averaging data from several cycles in both directions.

The quadrature data pulses from encoder 64 go to inventive computer based control unit 92 through cable 94. Control unit 92 converts the quadrature pulses to two channel directional pulses for direct use by control unit 92. The directional pulses are accumulated by control unit 92 and provide direct measure of material 38 position. Typical resolution of the material position measuring encoder is 0.001 inch.

Inventive computer based control unit 92 requires several inputs from control panel 96 to provide proper activation of sensor amplifier 98 to detect material target patterns 90, positioning of material correctly over die block 54, and proper actuation of the punch press. The control unit 92 must receive data regarding the characteristics of the detected pattern, position of the patterns on the material, and distance the detected pattern must be moved from sensor to die area. With this information and encoder data, control unit 92 generates a window pulse which starts a few thousandths of an inch before each mark 90 is supposed to reach sensing area 34 and stops a few thousandths of an inch after each mark is supposed to leave sensing area 34. This window pulse activates sensor amplifier 98 through cable 100. Thus amplifier 98 generates signals when marks 90 are moving through sensing area 34. Pulses coincident with the passages of the edges of the marks through the sensing area 34 are transmitted back to control unit 92. Control unit 92 combines these pulses with the encoder data to precisely locate the target marks relative to material position in the inventive material moving mechanism. For some patterns more than one window pulse per pattern must be specified and generated by control unit 92.

The material moving mechanism, under the supervision of control unit 92 moves each mark in sequence into position over die block 54, then actuates the punch press or other machining operation, then repeats the process. Concurrently, as each mark 90 passes through sensing area 34 the mark edge data position is recorded by control unit 92, the relative position of each edge is checked by the control unit and compared with the fine structure definition of the mark which has been preset into the computer through the control panel. If the edge positions and polarity check good, the mark position is then calculated and recorded, and proper mark position over die block 54 is calculated and recorded. If the mark edge positions are not in tolerance or the brightness polarity is not correct or the number of edges is wrong, then a bad mark flag is set and the recorded mark position is centered in the window. With a bad mark flag set, the part associated with that mark is defined as a bad part by the computer. As will be understood, flagging is one manner of comparing and recording the results of the recorded information to a standard and other methods could be employed. The control unit must also receive data on bad parts to punch, bad parts to skip, should strip pull back be actuated, last parts correction, and progressive die station details.

There are applications for the inventive material registration system where important elements from two inventive material moving and sensing systems are required. A single inventive computer based control system with full time dual sensing data handling, full time dual encoder data handling, and full time dual servo motor control is then required.

Figure 12:
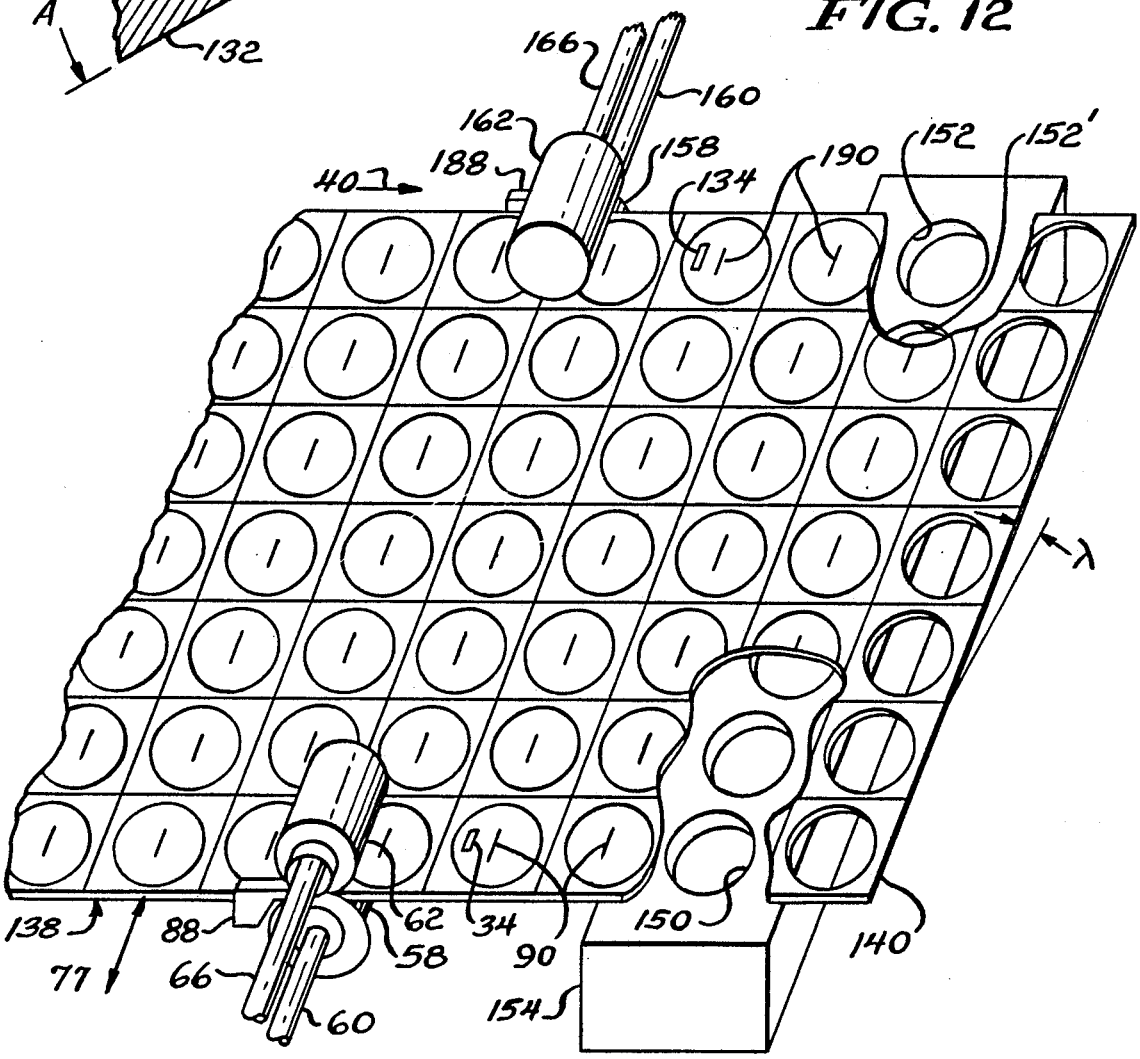
FIG. 12 illustrates a dual pattern detector and material moving system.

One of these applications is shown in FIG. 12. Decorated sheet 138 is moved in direction 40 across die block 154. With wide sheets, the edge control system shown in FIG. 6 may not provide adequate rotational control of the sheet. To provide accurate positioning of decorated parts over die holes 150 and 152 as well as die hole 152' in die block 154, a second independent material moving and sensing mechanism is desirable. This is illustrated in FIG. 12 by sensing area 134, encoder roller 162, encoder shaft 166, drive roller 158, drive roller shaft 160, and brake shoe arm 188.

In operation, sheet leading edge 140 is fed into the nip of encoder roller 62 and drive roller 58 and the nip of encoder roller 162 and drive roller 158. When there is no material in either nip, the control system powers the servo motors to drive both drive rollers in the direction to move material toward die block 154. As described previously, without material in the nip, the encoder rollers are stationary, braked by brake shoes 88 and 188. As soon as edge 140 of material 138 enters one of the nips, the control system senses the rotation of the encoder and stops the corresponding servo motor after a fixed material advance; for example, 0.1 inch measured by the encoder. As soon as the material enters the second nip and is stopped, the control system powers both servo motors to advance material 138 past sensing areas 34 and 134. Registration marks 90 and 190, along each side of material 138 are sensed by their corresponding sensors as they pass through sensing areas 34 and 134. Each side of the sheet is controlled to move independently in response to data generated by each encoder and each sensor and processed by the control system.

With the two sides independently controlled the pattern is properly positioned over die hole 162 using data from sensing area 134 and the pattern is properly positioned over die hole 150 using data from sensing area 34. By positioning each side correctly, the material has been moved to the proper X position in direction 40 and the rotation of the sheet λ has been properly controlled. The Y position, direction 77, is controlled by the flange on drive roller 58 and the angle of drive roller 58 and encoder roller 62 as previously described. No flange or angle are used on drive roller 158 and encoder roller 162 thus allowing the positioning to be controlled by drive roller 58 and encoder roller 62.

This same arrangement can be used in other applications where X and/or Y and rotational control of a sheet is required such as shearing, printing, hot stamping or component mounting.

Y position control can be related to the pattern by providing X and Y sensor data as described below. By combining X and Y sensor data from both systems and providing a servoed support frame as previously described, the sheet can be registered to the correct X position, correct rotation angle λ and the best average Y position. The required computations and positioning are completely controlled by the inventive microprocessor control system.

The measurement of pressure roller rotation which has been described as using an encoder for generating rotation data, can obviously be accomplished by other means such as a resolver and resolver data converter. Use of these and other alternate rotation sensors is considered to be within the scope of this invention.

The servo drive motor could, alternately, be a stepper motor, DC motor, AC motor, or hydraulic motor and the use of any such motors is within the scope of this invention.

Figure 8:
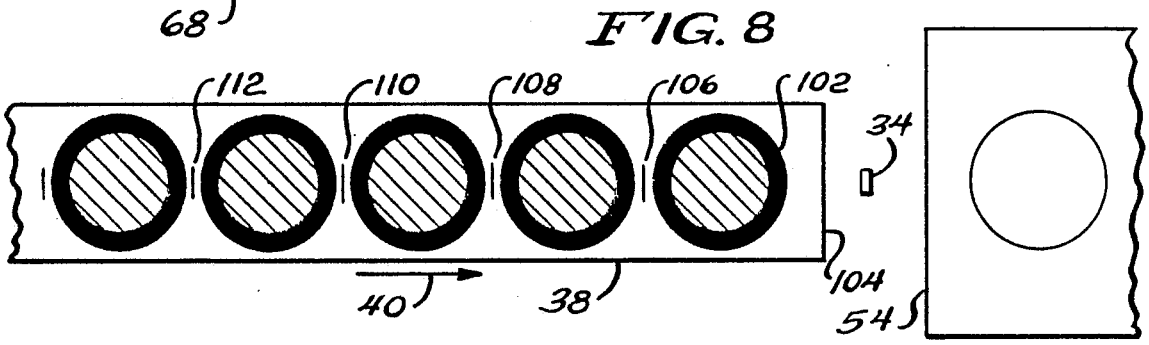
FIG. 8 is a schematic representation of a typical strip of decorated material used with the inventive system.

FIG. 8 shows a typical strip of decorated material 38 which would be fed in direction 40 past sensing area 34 and positioned in die area 54 by the inventive registration positioner system. In practice the first pattern 102 is not accurately printed relative to the end of the strip 104. The scrap dimension from 104 to 102 typically varies ±1/16 inch. The step up dimension between pattern registration marks 106 to 108 to 110 to 112 typically varies less than ±0.005 inch. The space between patterns is typically a minimum of 1/16'.

If there is ±1/16' scrap dimension variation and the nominal dimension between end of strip 104 and the first registration mark 106 is set into the inventive control system to generate the window for detecting mark 106 the window must be ⅛" plus the width of the mark to be sure the mark 105 will pass the sensing area 34 while the window is open. But the space between successive patterns is only 1/16" so the edges of the patterns will also generate signals in the window creating false mark data. This problem is solved in the inventive computer control system by using a "premark" which occurs on the pattern before the first registration mark. In this case the nominal dimension from 104 to 102 would be set in for the premark dimension, the premark would be defined as an edge and the premark window set to ⅛". This mark signal would now have no false mark data created by a nearby pattern. The dimension from pattern edge 102 to the first registration mark 106 is now set and the registration mark window set for just 0.020" larger than the mark width. This would typically call for a window of 0.040 inch. This small window eliminates the problem of a nearby pattern generating false mark signals. The step up dimension 106 to 108 to 110 etc., is set next. The same mark characteristics and window dimensions are used for all registration marks. The step up dimension is the same for all parts and the inventive system corrects for all step up variations.

As described previously the inventive computer control system handles all the data set in regarding material pattern characteristics and dimensions and opens and closes windows at the proper material positions and checks for proper data signal generation in each window before computing each mark position and storing it.

The control system also controls the initiation of the machining operation and measures the cycle time of the machining. The control system also knows the length of time before the material will be positioned in the machining area. With this information the control system can initiate the machining cycle before the material is actually positioned. This feature can significantly increase system cyclic speed when there is a long delay between machining cycle initiation and actual machining.

After machining, the material may be stuck in the machining area. The inventive control system may be preset to move the material back and forth several times to break the material loose from the machining area before moving the next part into the machining area. This function, which may be preset into the control system memory during setup is called "strip pull back." If the material remains stuck, the absence of proper encoder signals indicates the possibility of machining damage and machining is terminated.

Machining may involve operations in several positions as the material is advanced, as in a progressive die. If the inventive system is to be used to register material in several machining stations, simultaneously, it is obvious that only one station can have the sensing mark accurately registered. The inventive material positioner provides for selection of any one station in a multi-station machining operation as the primary register station and it provides for the selection of one or more secondary register stations prior to the primary station and/or after the primary station. Positioning and machining of the material in secondary stations after the primary station are controlled by continuing each material advance by a preset dimension added to the primary station position after the last pattern has been positioned and machined in the primary station. Control is the same for secondary stations prior to the primary station except the preset dimension advances are subtracted from the primary station position instead of being added.

To reduce the possibility of sensing an incorrect mark, in some instances it is desirable to have 2 or more lines or a combination of lines and edges form the registration mark to be detected. The internal fine structure dimensions of the edges of the mark as well as tolerances on these dimensions may also be set. The marks of course may be brighter or darker than background and this must also be set. The inventive control system allows the mark to be defined completely and a mark that appears in the window that does not meet the preset criteria will be rejected as a bad mark.

If a bad mark is sensed the control system provides the option of machining one or more parts with bad marks and it also provides the option of skipping one or more parts with bad marks. These options are all presetable when the particular material characteristics are set into the control system memory.

Figure 9:
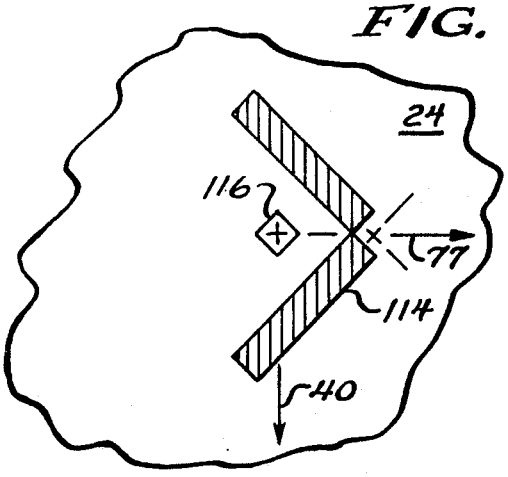
FIG. 9 is an enlarged detail of a target pattern-sensing area configuration of the invention for 2 axis sensing and correction.

It is a feature of the invention that use of particular patterns with edges not perpendicular to the direction of material travel in combination with the inventive material registration system heretofore described, permits the sensing of pattern alignment in two dimensions. FIG. 9 illustrates a target pattern 114 and sensing area 116 configuration of this type and which provides 2 axis pattern position data. The material carrying target pattern 114 is transported in the X direction 40 by the inventive material moving mechanism. Sensing area 116 is preferably square, as shown, to provide best signal to noise ratio and accurate detection of target pattern position. Under certain conditions, any type of two axis sensing symmetry provides pattern edge detection almost as accurate. For certain patterns having good edge definition or other sharp identifiable features, it is of course both possible and practicable to use a portion of the material pattern itself as the target pattern rather than printing a separate pattern.

Figure 10:
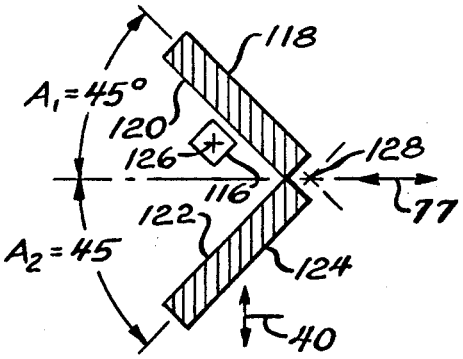
FIG. 10 illustrates the preferred embodiment of sensing area and target pattern in an orthogonal view for 2 axis sensing and correction.

FIG. 10 shows the preferred embodiment of sensing area 116 and target pattern 114 in a large orthogonal view. The X & Y positions of pattern 114 relative to sensing area 116 are detected in the following way. As pattern 114 is transported past sensor area 116 in the X direction 40 by the inventive material moving mechanism, encoder 64 sends pulses to control 92 to record material X position, each of the four edges 118, 120, 122 and 124 generate a pulse from sensor amplifier 98 as they pass the center 126 of sensor area 116. Each pulse is used by control unit 92 to record encoder 64 and thus material X position The four recorded encoder positions are then used in the following computation to determine material X position when the pattern is centered on the sensor center 126 and pattern Y position relative to the sensor center.

X 118=material position as edge 118 passes sensor center 126

$$\frac{X\,118 + X\,120 + X\,122 + X\,124}{4} = X \text{ position of material when pattern is centered on the sensing center 126}$$

-continued $$\frac{X\,118 + X\,120}{4} - \frac{X\,122 + X\,124}{4} = Y \text{ position of pattern center 128 relative to sensor area center 126}$$

The above relationships are true only if angles A1=A2=45°

In the general case for

A1=A2=$\theta$ where $20° < \theta < 70°$ $$\frac{X\,118 + X\,120 + X\,122 + X\,124}{4} = X \text{ position}$$

$$\frac{(X\,118 + X\,120 - X\,122 - X\,124)\text{COT}\,\theta}{4} = Y \text{ position}$$

Figure 11:
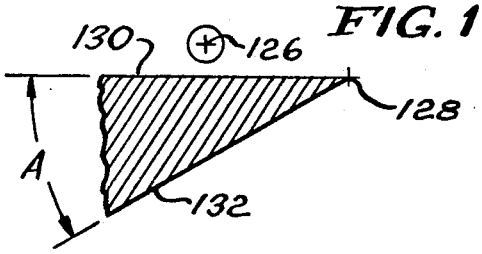
FIG. 11 illustrates a solid pattern in relation to a round sensing area.

For FIG. 11 using a solid pattern with center 128 and a round sensing area with center 126, X 130=X position

[X 130−X 132] COT A=Y position

If the sensing area is not round, but has two axis symmetry, the equations are the same. Only sensitivity or signal-to-noise ratio is affected by area shape.

The sensor detects the position of the edges of the target patterns as they pass through the sensing area and sends pulses to the control system coincident with the passage of each pattern edge. The control system combines the encoder data from the material mover and the pattern edge pulse data from the sensor and computes and stores X position or X and Y position of each pattern edge or center. If the pattern is a line the system records the leading edge of the line and the trailing edge of the line and computes and stores the encoder position of the center of the line.

After the X position of the pattern edges are sensed by the inventive sensing system and the Y position computed and stored by the inventive control system the Y position data can be used in one of two ways. If the mounting assembly for the material moving mechanism includes a Y axis (in/out) positioning device, this device can be controlled by the inventive control system to move the mounting assembly in or out in response to the Y data. If an in/out positioner is not included on the mounting assembly the Y data can be used to signal the operator and/or stop the machining operation if the value of Y goes outside preset limits.

Patterns comprising any number or lines or combinations of lines and edges can be specified by the pattern requirements selected in the control system. If the pattern sensed does not correspond, a bad part flag is generated which allows the part corresponding to that pattern position to be left in the material without machining Distributed patterns requiring more than one window per pattern can also be specified the primary use of the multiple windows per pattern is to further assure that the correct pattern marks are being sensed. Multiple windows are also used in X - Y pattern sensing where the angular pattern marks needed for Y sensing are interspersed with extraneous marks that would make the Y computation more difficult.

The above examples have illustrated the inventive combination of sensor, material mover and computer control system. In each case the material mover transports the decorated material, moving the target pattern past the sensor. The material mover also generates encoder pulses corresponding to material travel and sends them to the control system.

From the foregoing description, it can be seen that the invention is well adapted to attain all of the ends and objects set forth together with other advantages which are obvious and inherent to the material registration and transport system. Further, it should be understood that certain features and subcombinations are useful and may be employed without reference to other features and subcombinations. In particular, it should be understood there has been described in connection with the various peripheral memory, inputs/outputs and concommitant software programs but that though described in the manner of particular elements and programs, other computer elements and programs may be employed to achieve a similar result.

The detailed description of the invention herein has been with respect to preferred embodiments thereof. However, it will be understood that variations and modifications can be effected within the spirit and scope of the invention as described hereinabove and as defined in the appended claims.

What is claimed is:

1. A patterned material registration and computer based control system where position of a pattern on the material is detected by one or more optical pattern brightness detector systems and said pattern material is advanced to one or more machining stations, comprising a material movement system under control of said computer based control system to register one or more patterns in said machining stations, control panel means for entering the defined characteristics of one or more patterns of said patterned material;

said one or more optical pattern brightness detector systems each being mounted in a fixed position relative to said machining stations to view one or more selected portions of at least one pattern to generate a signal when contrasting edges of said selected portions of said patterned material move into the sensing area of said optical pattern brightness detector systems, said computer based control system being connected to said control panel means and said optical pattern brightness detector systems and responsive to the outputs thereof for storing said defined characteristics and for measuring the sensed characteristics of said patterned material, including means for comparing said sensed and measured characteristics with said defined and stored characteristics, said computer based control system being responsive to the signals resulting from the movement of one or more edges of a single pattern into the sensing area of said one or more optical pattern brightness detector systems to control the movement of said patterned material with said material movement system, each of said optical pattern brightness detector systems comprising a bifurcated fiber optic bundle having its common end located near the plane of said patterned material, one section of the opposite end of said bifurcated fiber optical bundle being illuminated by an illumination source to thereby illuminate said pattern, the other section of said bifurcated bundle carrying the reflected pattern illumination to sensor means for generating a signal output representative of the brightness of said reflected pattern illumination, and an optically fast lens between the plane of said pattern and said common end fibers to substantially focus said common end fibers on said pattern and said pattern on said common end fibers.

2. A patterned material registration system in accord with claim 1, the improvement further comprising selective distribution of illumination transmitting and image transmitting fibers at said fiber optic bundles common end.

3. A patterned material registration system in accord with claim 1, the improvement further comprising selection of the diameter of individual ones of said fibers comprising said bifurcated fiber optic bundle, to be smaller than the resolution ability of said optically fast lens.

4. A patterned material registration system in accord with claim 1, the improvement further comprising material movement sensing means coupled to said material movement means and connected to said computer based control system to continuously provide said computer based control system with material position, said computer based control system further comprising window pulse generating means for generating one or more window pulse per pattern in response to said defined characteristics and material position to activate said comparison means when selected pattern edges are moving through the sensing area of said detector system and deactivate said comparison means at other times.

5. A material moving and computer based control system of the type utilizing feed rollers acting on the material to move it into a machining area, comprising control panel means connected to said computer based control system for entering one or more selected computer based control system measured material movement lengths, a servo driven roller to effect material movement and a non-driven pressure roller cooperatively associated with said servo driven roller to move the material, rotation measuring sensor means coupled to said pressure roller and connected to said computer based control system, said computer based control system being responsive to signals from said rotation measuring sensor means and inputs from said control panel means to thereby measure and signal the length of said material that has passed between said rollers, said pressure roller being spaced apart from said servo driven roller a distance less than material thickness whereby said pressure roller is driven only when material is located between said pressure roller and said servo driven roller.

6. In a material moving and computer based control system in accord with claim 5, the improvement further comprising material side guide means, flange means on said servo driven roller, and means for maintaining the axis of rotation of said rollers at an angle between 0.1 degree and 5 degrees from a perpendicular to the direction of travel of said material to thereby hold the edge of said material against said drive roller flange during material movement.

7. In a material moving and computer based control system in accord with claim 5, the improvement further comprising brake means affixed to said pressure roller to stop rotation of said pressure roller whenever material is not interposed between said pressure roller and said drive roller.

8. A material moving and computer based control system in accord with claim, 5 further comprising a further material moving system in accord with claim 7 located opposite said material moving system on the opposite edge of said material.

9. A material moving and computer based control system in accord with claim 6 further comprising brake means affixed to said pressure roller to stop rotation of said pressure roller whenever said material is not interposed between said pressure roller and said drive roller.

10. A material moving and computer based control system, in accord with claim 9, further comprising a further material moving and computer based control system in accord with claim 10.

11. A material moving and computer based control system in accord with claim 5, further comprising a second material moving system in accord with claim 7 aligned with and following said material moving system and adapted to move said material in the same direction and manner as said material system, and said computer based control system means being connected to each of said rotation measuring sensor means and responsive to the outputs thereof to drive the servo of both material moving systems under the initial control of the first material moving system's rotation measuring sensor means and to transfer that control to the second material moving system's rotation measuring sensor prior to deactivation of said first system's rotation measuring sensor.

12. A patterned material registration and computer based control system for optically registering, sequentially advancing to one or more machining stations and stopping in said machining stations for machining at least one pattern on patterned material, comprising one or more optical pattern brightness detector systems each having a sensing area and each mounted in a fixed position relative to said machining station to view at least one selected portion of said pattern and connected to said computer based control system to generate a signal when a contrasting edge of each selected portion of said patterned material moves into a sensing area, material moving mechanism means including one or more sets of pinch rollers to move said patterned material in one axis, material movement sensing means coupled to said material moving mechanism means and connected to said computer based control system whereby the position of said patterned material is continuously measured when it is between said pinch rollers, said computer base control system including means for initiating a machining cycle, control panel means for entering the defined characteristics of at least one selected portion of said patterned material, said computer based control system also being connected to said control panel means for storing said defined characteristics and for measuring the sensed characteristics of said patterned material, including means for comparing said sensed and measured characteristics with said defined and stored characteristics, said computer based control system being responsive to the signals from a single pattern to control the movement of said patterned material with said material moving mechanism means and locate said single pattern in a stationary position a selected distance from one or more sensing areas, and initiate said machining cycle when said signals from said single pattern meet said defined and stored characteristics.

13. A material registration and computer based control system in accord with claim 12 further comprising means for generating a bad part flag to identify a pattern whose sensed and measured characteristics do not match said defined characteristics.

14. A material registration and computer based control system in accord with claim 12 further comprising means for recording material position as each selected pattern edge passes each said sensing area, means for comparing a function of each recorded material position with said defined pattern characteristics, and means for generating a bad part flag is said comparison reveals said function does not match said defined pattern characteristics.

15. A material registration and computer based control system in accord with claim 14 further comprising means for preventing initiation of said machining cycle and preventing material movement when a part identified by a bad part flag is in a machining area.

16. A material registration and computer based control system in accord with claim 14 further comprising means for preventing initiation of said machining cycle upon a part identified by a bad part flag and for initiating material movement thereafter to thereby skip machining of said bad part.

17. A material registration and computer based control system in accord with claim 14, further comprising means for directing said system to disregard said bad part flag to thereby effect machining cycles on parts with patterns whose sensed characteristics do not match said defined characteristics.

18. A material registration and computer based control system in accord with claim 12 further comprising said control panel means being adapted to enter defined characteristics of said material and at least two portions of the pattern thereon one of which is used as a premark pattern, said computer based control system including means for storing said defined characteristics of said premark pattern whose characteristics and position on the material are separately definable from other patterns thereon, and means for sensing and verifying said premark characteristics.

19. A patterned material registration and computer based control system for optically registering and advancing to a matching station a material bearing patterns thereon comprising at least one optical pattern brightness detector system means having sensor means mounted in a fixed position relative to said machining station to view a selected portion of said pattern to generate output signals when contrasting edges of said selected portion of said patterned material move into the sensing area of said optical pattern brightness detector system means, a material moving system including material movement measuring sensing means, said computer based control system including control panel means for entering and processing means for storing the defined signal characteristics of one or more patterns of said patterned material and the patterns thereon, said computer based control system being connected to said material movement measuring sensing means and to said optical pattern brightness detector system means to receive said output signals and including means for comparing said sensed and measured signal characteristics with said defined and stored characteristics, pattern mark means on said material, said pattern mark means having edges not perpendicular to the direction of material travel, and said computer based control system including computing means responsive to said output signals of said optical pattern brightness detector system means, said material movement measuring sensing means and said defined characteristics t generate X and Y position information for a single pattern mark from material movement only in the X direction.

20. A patterned material registration and computer based control system in accord with claim 19, further comprising means responsive to said X and Y position information to position said pattern relative to said sensing area in both the X and Y directions in conformity with said X and Y position information.

21. A material moving and computer based control system in accord with claim 5 further comprising means in said computer based control system for driving said servo driven rollers in a reverse direction after each machining operation prior to advancing the next succeeding section of said material into said machining area.

22. In a material registration and control system for optically registering and advancing to a machining station at least one pattern on the material comprising one or more optical pattern brightness detector systems each having a sensor for sensing pattern characteristics, a material moving mechanism including a material movement sensing means, and a computer based control system including means for initiating a machining cycle and control panel means for entering the defined characteristics of said patterned material, the improvement comprising means within said control system for designation of one primary station in a multi-station machining area for positioning of a pattern sensed by said optical pattern brightness detector, means for selection of any number of secondary machining stations prior to said primary station and any number of secondary machining stations after said primary station, and means for presetting an advance dimension which is added at least once to primary station position.

23. A material moving and computer based control system comprising at least one servo driven roller and a non-driven pressure roller for each driven roller in accord with claim 5 further comprising said computer based control system including computer control means to detect and measure the rotation of each of said rotation measuring sensor means when the leading edge of moving material enters the space between said pressure rollers and said servo driven rollers to thereby detect and measure the position of the leading edge of said material in at least one location along the edge of said material.

24. A material registration and computer based control system in accord with claim 12 further comprising computer based control system means for cyclically moving a register mark back and forth through said sensing area of said one or more optical pattern brightness detector systems, and further means in said computer based control system for recording and averaging the measured position data from more than one cycle of said back and forth movement.

25. In a dual material moving and control system comprising a first and a second sequentially disposed material moving system each having a servo driven roller and a non-driven pressure roller cooperatively associated therewith, rotation measuring sensor means coupled to each of said pressure rollers to thereby measure and signal the length of said strip material that has passed between said driven roller and associated pressure roller, the improvement comprising control means connected to each of said rotation measuring sensor means and responsive to the outputs thereof and to the advance-to-die dimension of each of said servo driven rollers to drive the servo drives of each material moving system a first advance to die dimension under the initial control of the first material moving systems rotation measuring sensor and to transfer that control to the second material moving systems rotation measuring sensor prior to deactivation of said first systems rotation measuring sensor to drive the servo drives of each material moving system a second advance to die dimension to thereby effect a last parts correction.

26. A material moving and computer based control system in accord with claim 5 further comprising means within said computer based control system to generate a machining initiation signal a computed time after completion of a machining cycle, said computed time being sufficient to advance said material into machining position before machining occurs.

27. A material moving and computer based control system comprising at least one servo driven roller and a non-driven pressure roller for each driven roller in accord with claim 5 further comprising said computer based control system including means to detect and measure the rotation of each of said rotation measuring sensors and to detect the absence of proper rotation of each of said rotation sensors when torque is applied to said servo driven roller and terminate the machining cycle upon detection of the absence of proper rotation of anyone of said rotation sensors.

* * * * *